United States Patent [19]

Newman et al.

[11] Patent Number: 5,018,996

[45] Date of Patent: May 28, 1991

[54] FLOW CONTROL FLUID COUPLING MARINE TRANSMISSION

[75] Inventors: Neil A. Newman, Omro, Wis.; Thomas C. Bowen, Thousand Oaks, Calif.

[73] Assignee: Brunswick Corporation, Skokie, Ill.

[21] Appl. No.: 463,083

[22] Filed: Jan. 10, 1990

Related U.S. Application Data

[63] Continuation-in-part of Ser. No. 218,831, Jul. 13, 1988, abandoned.

[51] Int. Cl.[5] ..... B63H 23/08; B63H 23/26; B63H 23/30

[52] U.S. Cl. ..... 440/75; 60/354; 475/40; 475/41; 475/42

[58] Field of Search ..... 440/75; 475/35, 40, 475/41, 42; 60/354

[56] References Cited

U.S. PATENT DOCUMENTS

| | | | |
|---|---|---|---|
| 2,812,670 | 11/1957 | Winther | 475/41 X |
| 2,890,600 | 6/1959 | Smirl et al. | 475/45 |
| 3,359,830 | 12/1967 | Liang | 475/40 X |
| 3,398,532 | 8/1968 | Egbert et al. | 60/354 |
| 3,407,600 | 10/1968 | Meyer | 440/75 |
| 4,047,383 | 9/1977 | Johnson et al. | 60/354 |
| 4,558,769 | 12/1985 | Neisen | 192/3.31 |

*Primary Examiner*—Sherman Basinger

*Attorney, Agent, or Firm*—Andrus, Sceales, Starke & Sawall

[57] ABSTRACT

A fluid coupling transmission is adapted for interposition between the engine and the propulsion unit of a marine drive. The fluid coupling transmission provides variable speed operation in both forward and reverse. A fluid pump is drivingly connected to the engine crankshaft, and is adapted to drive a turbine. A series of variable position vanes are disposed between the fluid pump and turbine at the entrance of fluid into the pump, for controlling the power transfer therebetween by controlling the amount of fluid passing through the pump and acting on the turbine. A ring gear is connected to the turbine, and a sun gear is connected to the output shaft of the transmission. One or more planet gears are provided between the ring gear and the sun gear, and are rotatably mounted to a carrier member, which extends coaxially with respect to the output shaft. An output control mechanism, including a brake band and a plate clutch mechanism, is selectively engagable with the carrier member so as to control the direction of rotation of the transmission output shaft.

14 Claims, 1 Drawing Sheet

FLOW CONTROL FLUID COUPLING MARINE TRANSMISSION

CROSS REFERENCE TO RELATED APPLICATION

This application is a continuation-in-part of application Ser. No. 07/218,831, filed July 13, 1988, now abandoned.

BACKGROUND OF THE INVENTION

This invention relates to a transmission system for a marine drive.

In a conventional marine drive, including an engine and a propulsion unit, the engine is directly and mechanically connected to the propeller through a gear box. As a result, the speed of the propeller is directly proportional to the speed of the engine in a ratio established by the gears of the gear box.

It has been recognized that the usual selection of marine drive characteristics provides unsatisfactory boat performance at low-speed operation, such for trolling or docking. Mechanisms for improving the low-speed performance of a boat are disclosed in my copending patent applications Ser. No. 07/255,618 filed Oct. 11, 1988, now U.S. Pat. No. 4,887,984, Ser. No. 07/118,862 filed Nov. 9, 1987, now U.S. Pat. No. 4,820,209 and Ser. No. 07/232,703, filed Aug. 16, 1988, now U.S. Pat. No. 4,919,009 Ser. No. 07/255,618 now U.S. Pat. No. 4,887,984, discloses a fluid coupling apparatus in connection with a series of stationary variable position vanes disposed between the pump and the turbine components of the fluid coupling. The vanes are movable so as to govern the direction of impingement of fluid on the turbine component of the fluid coupling. The position of the vanes governs the amount of power transferred from the fluid pump to the turbine, as well as the direction of rotation of the turbine. Ser. No. 07/118,862, now U.S. Pat. No. 4,820,209, discloses a fluid coupling structure including a fluid pump, a forward driven turbine and a reverse, or reaction, driven turbine. The forward and reaction turbines are connected to concentrically extending shafts. Through a series of gears, clutches and brakes, the forward and reverse turbine shafts drive an output shaft in either a first or second rotational direction, for propelling the boat in either a forward or reverse direction. A variable force brake is operable on the output shaft, to control, its, power output. Ser. No. 07/232,703 now U.S. Pat. No. 4,919,009, discloses a fluid coupling transmission having forward and reverse turbines which are rotatable in the same direction of rotation in response to rotation of a fluid pump. A one-way clutch is provided on the forward turbine for transmitting power to an output shaft only in one direction of rotation. A planetary gearset is provided between the reverse turbine and the output shaft, and the planet gears of the gearset are rotatably mounted to a carrier member. A selective engagement mechanism, including a plate clutch disposed between the carrier member and the output shaft, and a brake band selectively engageable with the carrier member, is operable to control the direction of rotation of the output shaft. The reverse turbine includes a series of movable vanes for providing variable power output from the transmission.

The present invention is also directed to a structure for providing improved low-speed and variable speed operation of a boat. A fluid coupling is provided between the marine drive engine and the gear box to which the propeller is connected. The fluid coupling includes a rotatable fluid pump connected to the engine and rotatable in response to rotation of the engine crankshaft. A rotatable turbine is adapted to be driven by the fluid pump, and a series of variable position vanes are provided between the fluid pump and the turbine at the entrance of fluid into the fluid pump, for controlling power transfer therebetween by governing the amount of fluid entering the pump, and thereby exiting the pump and acting on the turbine. A rotatable output shaft is provided for outputting power from the fluid coupling, and a sun gear is fixed to the output shaft. A ring gear is connected to and rotatable with the turbine, and one or more planet gears are disposed between the sun gear and the ring gear. An output control means governs the direction of rotation of the rotatable output shaft. In one embodiment, the one or more planet gears are rotatably mounted to a carrier member, which extends concentrically along at least a portion of the length of the output shaft. The output control means includes a clutch mechanism for selectively clutching the carrier member to the output shaft, and a brake mechanism for selectively preventing rotation of the carrier member. A lock-up clutch is provided for directly mechanically coupling the output shaft to the fluid pump, so as to bypass the effect of the fluid coupling in response to certain predetermined operating conditions.

With the above-described construction, the brake mechanism and the clutch mechanism can be selectively engaged to prevent rotation of the output shaft, or to provide rotation of the output shaft in either a first or a second direction of rotation.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
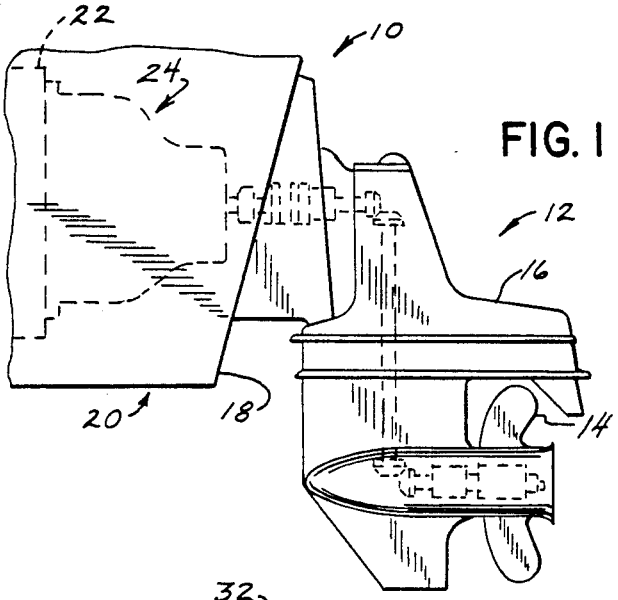
FIG. 1 is a partial elevation view showing the improved marine drive of the present invention.

As shown in FIG. 1 a marine drive 10, shown as an inboard-outboard stern drive, includes a propulsion unit 12 having a propeller 14 and a gear box 16, as is well known. These elements are mounted on the exterior of transom 18 of a boat 20. An engine 22 of conventional construction is mounted inside boat 20.

Figure 2:
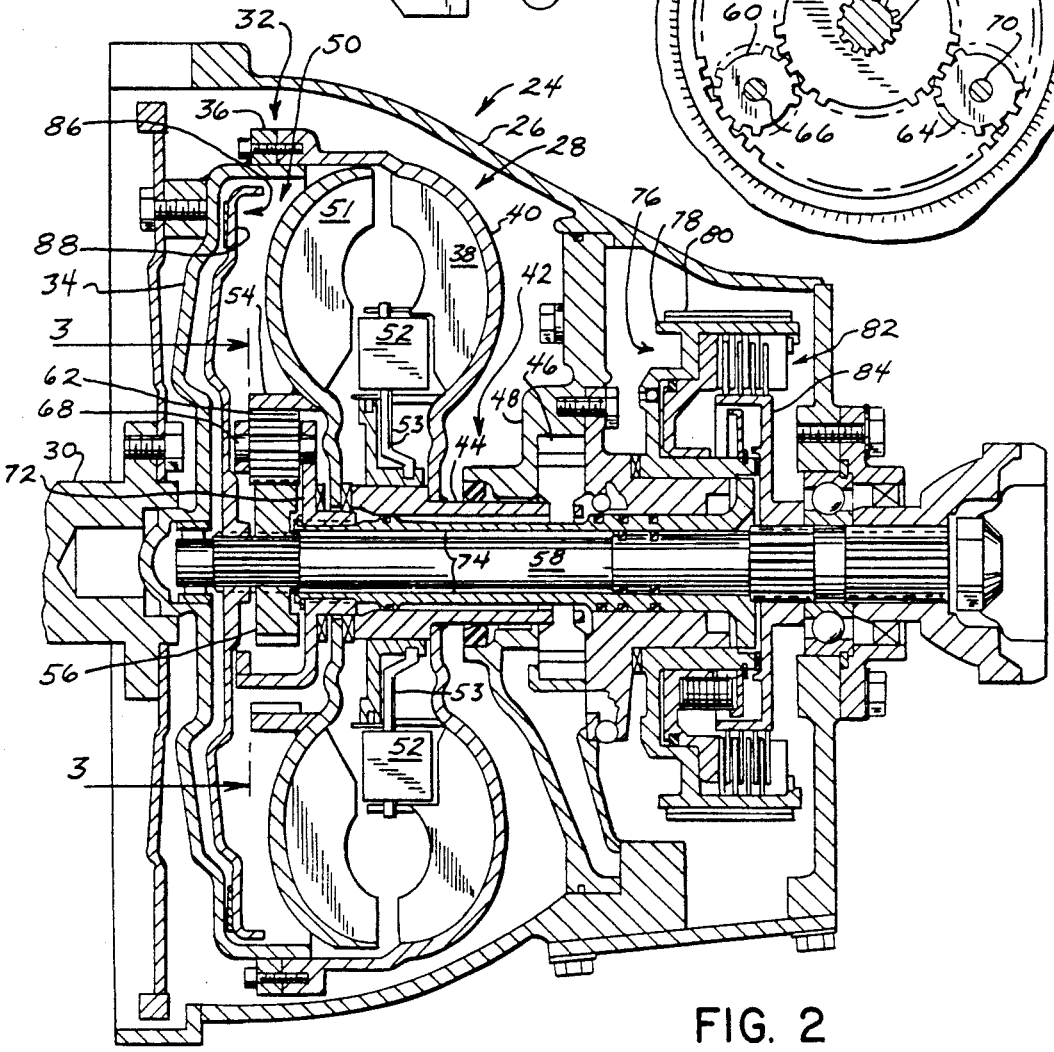
FIG. 2 is a sectional view showing the internal components of the fluid coupling marine transmission of FIG. 1.

In accordance with the present invention, a fluid coupling transmission 24 is interposed between engine 22 and propulsion unit 12. As shown in FIG. 2, fluid coupling transmission 24 has a housing 26 bolted or otherwise connected to the engine block (not shown) of engine 22. A fluid pump or driving member 28 is coupled to the crankshaft 30 of engine 22 through a casing assembly 32, which includes a cover 34 having a flange 36 to which fluid pump 28 is bolted or otherwise connected. Fluid pump 28 forms the power input of transmission 24. Pump 28 includes a plurality of impeller blades 38 in a cup-like frame 40, which circulate hydraulic fluid through casing 32.

An oil pump assembly, shown generally at 42, includes an impeller 44 connected to and rotatable with pump 28. Impeller 44 is provided with a plurality of vanes, such as shown at 46, contained within a pump housing 48. Oil pump assembly 42 circulates oil and provides fluid pressure within casing 32.

A turbine, or driven member, 50 is disposed within casing 32 and is rotatable in response to rotation of fluid pump 28. Turbine 50 includes a plurality of blades 51, which are driven by fluid circulated in casing 32 by fluid pump 28.

A series of movable flow control vanes 52 are provided between fluid pump 28 and turbine 50. Vanes 52 are disposed between the exit of fluid from turbine 50 and the entrance of fluid into pump 28, and control the amount of power transferred from fluid pump 28 to turbine 50 by controlling the amount of fluid which enters pump 28, and thereby exits pump 28 and acts on turbine 50. As shown, vanes 52 are connected to and rotatable with fluid pump 28. Vanes 52 are movable between an open position, as shown in FIG. 2, and a closed position by means of a series of cranks 53 associated therewith. As is known, cranks 53 are operable by means of fluid pressure to control the disposition of vanes 52. In their open position, vanes 52 allow substantially full power transfer between pump 28 and turbine 50. When in their closed position, vanes 52 block the flow of fluid entering fluid pump 28 from the discharge of turbine 50, and thereby prevent substantially all power flow from pump 28 to turbine 50. Cranks 53 provide variable positioning of vanes 52 between their open and closed positions, so that the amount of fluid allowed to enter pump 28 can be varied to provide variable power transfer between fluid pump 28 turbine 50. Cranks 53 can be selectively actuated, preferably by the boat operator, so as to control the disposition of vanes 52 and thereby the amount of power transferred to turbine 50 from pump 28.

Figure 3:
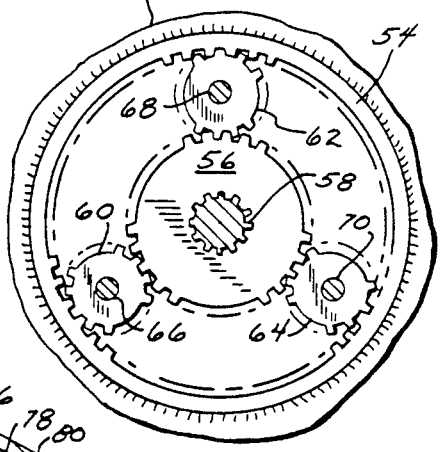
FIG. 3 is a partial sectional view taken generally along line 3—3 of FIG. 2.

A ring gear 54 is connected to and rotatable with turbine 50. Ring gear 54 has a series of teeth about its inner periphery. A toothed sun gear 56 is connected through a central passage to an output shaft 58, which forms the power output of transmission 24. As shown in FIG. 3, a series of planet gears, such as 60, 62, 64 are disposed between the inner surface of ring gear 54 and the outer surface of sun gear 56. Each of planet gears 60, 62, 64 is provided with a series of teeth about its outer circumference, which teeth are engageable with the teeth provided on ring gear 54 and sun gear 56.

Planet gears 60–64 are rotatably mounted about a central passage to pins 66, 68, 70, respectively, which are fixed to a flange 72 provided at the leftward end of a carrier member 74. Carrier member 74 is a substantially cylindrical member which extends coaxially relative to output shaft 58 along at least a portion of the length of shaft 58. Carrier member 74 is connected at its rightward end to a drum assembly, shown generally at 76, which includes an outer plate 78. Drum assembly 76 is connected to carrier member 74 so that rotation of carrier member 74 causes rotation of drum assembly 76.

A brake band 80 is provided adjacent the outer surface of drum outer plate 78, and is selectively engageable therewith to selectively prevent rotation of drum assembly 76, and thereby carrier member 74. A plate clutch mechanism, shown generally at 82, is provided between the inner surface of drum assembly 76 and a disc 84 fixed to output shaft 58. Clutch mechanism 82 is selectively actuable for selectively engaging drum assembly 76, and thereby carrier member 74, to output shaft 58.

A lock-up clutch assembly 86, including a clutch plate 88, is provided at the leftward end of output shaft 58. Lock-up clutch assembly 86 is selectively actuable in response to certain predetermined operating conditions, such as engine or boat speed, to directly mechanically couple output shaft 58 to cover 34 of casing 32, and thereby to engine crankshaft 30.

In operation, transmission 24 works as follows. To achieve a neutral condition, in which no power is output from transmission 24 by output shaft 58, both plate clutch assembly 82 and brake band 80 are engaged. In this instance, rotation of turbine 50 is prevented due to the locking of the planetary gearset. In the neutral condition, variable position vanes 52 are moved to their closed position, so that little or no fluid flow, and thereby power transfer, occurs between fluid pump 28 and turbine 50. In this manner, minimal force is exerted on turbine 50.

To provide reverse operation of boat 20 through transmission 24, brake band 80 is engaged with drum outer plate 78 and plate clutch mechanism 82 is released. In this manner drum assembly 76, and thereby carrier member 74, is held stationary. This prevents rotation of planet gears 60–64 about sun gear 56. When turbine 50 is driven by pump 28, rotation of ring gear 54 causes planet gears 60–64 to rotate about pins 66–70, respectively. Such rotation of planet gears 60–64 causes sun gear 56 to rotate in a direction opposite that of turbine 50. Rotation of sun gear 56 causes rotation of output shaft 58, so as to impart reverse movement to boat 20. The planetary gearset will overdrive propeller 14 during reverse operation to offset the lower efficiency of propeller 14 in reverse. The movable flow control vanes 52 control the amount of power transmitted from fluid pump 28 to turbine 50. The boat operator manually controls boat speed by adjusting the position of variable vanes 52, and thereby the power transmitted to turbine 50.

To drive boat 20 forward, brake band 80 is released from engagement with drum assembly 76 and plate clutch mechanism 82 is applied, thereby coupling drum assembly 76 and carrier member 74 to output shaft 58. In this condition, planet gears 60–64 are loaded and prevented from rotating about sun gear 56. Rotation of turbine 50, and thereby ring gear 54, causes rotation of output shaft 58 through the planetary gearset and plate clutch mechanism 82. As in reverse, the boat operator manually controls boat speed by adjusting the position of the flow control vanes 52 to control the power transmitted to turbine 50.

At a preselected engine or boat speed, lockup clutch mechanism 86 is engaged by applying clutch plate 88 to cover 34. In this manner, there is a direct mechanical connection between output shaft 58 and engine crankshaft 30, thereby bypassing the effect of the fluid coupling of transmission 24. In this condition, clutch mechanism 82 is released, thereby allowing the fluid coupling and planetary gearset to spin freely without absorbing power.

Various alternatives and modifications are contemplated as being within the scope of the following claims particularly pointing out and distinctly claiming the invention.

We claim:

1. In a marine drive for a boat, said marine drive including an engine and a propulsion unit, the improvement comprising a fluid coupling interposed int he marine drive between the engine and the propulsion unit, said fluid coupling comprising:

a rotatable fluid pump connected to the engine;

a rotatable turbine adapted to be driven by said fluid pump; and flow control means disposed between said fluid pump and said turbine for governing the amount of power transferred to said turbine from said fluid pump, wherein said flow control means comprises a series of vanes disposed between said fluid pump and said turbine adjacent the entrance of said fluid into said fluid pump, wherein said vanes are mounted to and rotatable with said fluid pump, said vanes being movable between an open position for allowing full flow of fluid into said fluid pump, and a closed position for substantially cutting off the flow of fluid into said fluid pump from said turbine, said vanes being movable to varying positions between said open and closed positions for varying the amount of fluid flow into said fluid pump, and thereby the amount of power transferred to said turbine from said fluid pump.

2. In a marine drive for a boat, said marine drive including an engine and a propulsion unit, the improvement comprising a fluid coupling interposed in the marine drive between the engine and the propulsion unit, said fluid coupling comprising:

a rotatable fluid pump connected to the engine;

a rotatable turbine adapted to be driven by said fluid pump;

flow control means disposed between said fluid pump and said turbine for governing the amount of power transferred to said turbine from said fluid pump, wherein said flow control means comprises a series of vanes disposed between said fluid pump and said turbine adjacent the entrance of said fluid into said fluid pump, said vanes being movable between an open position for allowing full flow of fluid into said fluid pump, and a closed position for substantially cutting off the flow of fluid into said fluid pump from said turbine;

rotatable output means;

planetary gear means disposed between said turbine and said rotatable output means, said planetary gear means including a rotatable sun gear connected to and rotatable with said rotatable output means; and output control means interconnected with said planetary gear means for controlling the direction of rotation of said rotatable output means.

3. The invention according to claim 2, wherein said rotatable output means comprises an output shaft coupled to said propulsion unit.

4. The invention according to claim 3, wherein said planetary gear means further includes a ring gear connected to and rotatable with said turbine, and one or more planet gears disposed between and engageable with said ring gear and said sun gear.

5. The invention according to claim 4, further comprising a carrier member to which said one or more planet gears are rotatably mounted.

6. The invention according to claim 5, wherein said output control means selectively engages said carrier member so as to control the direction of rotation of said output shaft.

7. The invention according to claim 6, wherein said output control means includes a clutch mechanism provided between said carrier member and said output shaft for selectively coupling said carrier member to said output shaft.

8. The invention according to claim 7, wherein said output control means further includes a brake mechanism selectively engageable with said carrier member for selectively preventing rotation thereof, so that said output control means is capable of providing rotation of said output shaft in a first rotational direction by releasing said brake mechanism and coupling said carrier member to said output shaft through said clutch mechanism so as to prevent rotation of said one or more planet gears about said sun gear so that, as said turbine and said ring gear connected thereto rotate in response to said fluid pump, rotation of said turbine is transferred through said planetary gearset to said output shaft, and said output control means is capable of providing rotation of said output shaft in a second rotational direction by releasing said clutch mechanism between said carrier member and said output shaft and engaging said brake mechanism with said carrier member so as to maintain said carrier member and said one or more planet gears stationary relative to said sun gear, so that rotation of said turbine and said ring gear causes rotation of said one or more planet gears about their rotatable mounting to said carrier member, said rotation of said one or more planet gears causing rotation of said output shaft through said sun gear in said second rotational direction.

9. The invention according to claim 8, wherein said carrier member is provided with a drum member connected thereto, and wherein said brake mechanism engages the outer surface of said drum member and said clutch mechanism is provided between the inner surface of said drum member and said output shaft.

10. The invention according to claim 2, further comprising lock-up means for directly mechanically coupling said fluid pump to said rotatable output means in response to one or more preselected operating conditions.

11. The invention according to claim 10, wherein said lock-up means comprises a selectively actuable clutch connectable between said fluid pump and said output means.

12. A marine transmission adapted for interposition in a marine drive between the engine and the propulsion unit thereof, comprising:

a fluid coupling including a rotatable fluid pump connected to and rotatable in response to the engine;

a turbine adapted to be driven in a first rotational direction by said fluid pump;

flow control means disposed between said fluid pump and said turbine for controlling the power transfer from said fluid pump to said turbine;

a rotatable output shaft;

a planetary gearset disposed between said turbine and said rotatable output shaft, said planetary gearset including a rotatable sun gear connected to and rotatable with said output shaft, a ring gear connected to and rotatable with said turbine, and one or more planet gears disposed between said ring gear and said sun gear;

a carrier member mounted concentrically about a portion of said output shaft, said one or more planet gears being rotatably mounted to said carrier member;

selectively engageable brake means for selectively preventing rotation of said carrier member; and selectively engageable clutch means disposed between said carrier member and said output shaft for selectively coupling said carrier member to said output shaft;

so that said output shaft can be rotated in a first rotational direction by releasing said brake means and coupling said carrier member to said output shaft through said clutch means so as to prevent rotation of said planet gears so that, as said turbine rotates in response to said pump, rotation of said turbine is transferred to said output shaft through said planetary gearset, and said output shaft can be rotated in a second rotational direction by releasing said clutch means between said carrier member and said output shaft and engaging said brake means with said carrier member so as to maintain said carrier member and said planet gears stationary relative to said sun gear, so that rotation of said turbine and said ring gear causes rotation of said planet gears about their rotatable mounting to said carrier member, said rotation of said planet gears causing rotation of said sun gear and thereby rotation of said output shaft in said second rotational direction.

13. The invention according to claim 12, wherein said flow control means comprises a series of movable vanes disposed between said fluid pump and said turbine for controlling the power transfer therebetween.

14. The invention according to claim 12, further comprising a lock-up clutch for selectively directly coupling said fluid pump to said output shaft in response to one or more preselected operating conditions.

* * * * *